United States Patent [19]

Lemoine

[11] Patent Number: 4,848,690

[45] Date of Patent: Jul. 18, 1989

[54] VERTICAL HOLDER FOR PERFORATED PAPER TOWELING OR OTHER MATERIAL

[76] Inventor: Mary E. Lemoine, 1747 N. West Ave., Vineland, N.J. 08360

[21] Appl. No.: 177,073

[22] Filed: Apr. 4, 1988

[51] Int. Cl.[4] ..... B65H 19/00

[52] U.S. Cl. ..... 242/55.54; 225/51; 225/67

[58] Field of Search ..... 242/55.2, 55.54; 225/67, 79, 46, 51

[56] References Cited

U.S. PATENT DOCUMENTS

| | | | |
|---|---|---|---|
| 3,319,855 | 5/1967 | Tucker et al. | 225/67 |
| 3,516,615 | 6/1970 | Wickenberg | 225/46 X |
| 4,030,676 | 6/1977 | Bardsley | 242/55.54 |
| 4,487,376 | 12/1984 | Compton | 242/55.54 |
| 4,720,053 | 1/1988 | Vance | 225/79 X |

*Primary Examiner*—David Werner

*Attorney, Agent, or Firm*—Norman E. Lehrer

[57] ABSTRACT

A vertical holder for perforated paper toweling or other material, having a rectangular back support, base and top rod support, removable large square paper roll rod, having a magnet in its base end, a side support, also used as a grasping area for moving the holder, a tension piece, to aid the separation of sheet material, and non-skid material covering the underneath surface of the base rod support. The holder is mountable vertically or horizontally on a wall, or horizontally underneath a counter or cabinet.

2 Claims, 1 Drawing Sheet

VERTICAL HOLDER FOR PERFORATED PAPER TOWELING OR OTHER MATERIAL

BACKGROUND AND SUMMARY OF PRESENT INVENTION

This invention is a vertical holder for perforated paper toweling or other material. Prior vertical holders are in need of a means to aid the separation of the perforated material from the roll and a means to provide a one hand operative holder, when material is removed, another needed feature is non-shifting or tilting of a holder on a surface.

The present invention eliminates all of the above mentioned problems. A tension piece pressing against the toweling aids separation of toweling, and provides the removal of toweling with one hand, one or as many as four sheets, with one pull. An added convenience is a small V indentation on the edge of the tension piece, for retrieving the towel edge, when the material was not pulled far enough before it was torn off, therefore leaving the perforated area back of the tension piece. When taring off toweling, no rolling of the toweling is experienced when the pull forward is stopped before the pull to tare off toweling is made.

The weight of the holder, combined with non-skid material approximately the shape of the base rod support, secured to plate metal or other material, attached by screws to the undersurface of the base support eliminates tilting and shifting of the holder when toweling is torn off.

The present holder provides a large paper roll rod that accommodates the two sizes of openings found in ten brands of perforated toweling. A further advantage is, the large rod keeps the roll material from shifting to one side of the base support, as the resut of pressure on one side from the tension piece.

A support piece secured to a frontward edge of the back support, opposite the tension piece, and to top and base rod support, provides a strongly constructed holder and an area for grasping when moving the vertical holder.

The space between the rod support ends being slightly more than the length of conventional roll toweling, the shallow opening in the base rod support end slightly oblong shaped and $\frac{1}{8}''$ closer to the front end of the base support than the top rod support opening, also a straight cut on the end of the rod, a magnet in the end of the rod and metal in the shallow oblong opening, eliminates shifting of the rod and falling from the holder when mounted in a horizontal position.

DETAILED DESCRIPTION OF A PREFERRED EMBODIMENT

The holder may be made of any suitable material, preferably wood, various groving may be used for decoration.

Figure 1:
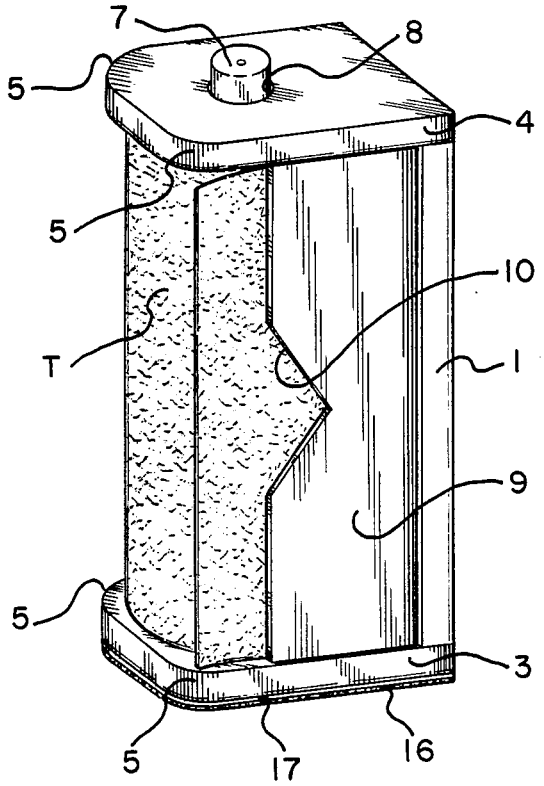
FIG. 1 is a perspective view of the holder with toweling.

FIG. 1 is the holder with toweling T, two rod support ends, 3 and 4, rounded corners thereupon 5, towel support rod 7, opening 8, back support 1, tension piece 9, thereupon indentation 10, non-skid material 16 and metal plate or other suitable material 17, attached to undersurface of base rod support 3 by screws.

Figure 2:
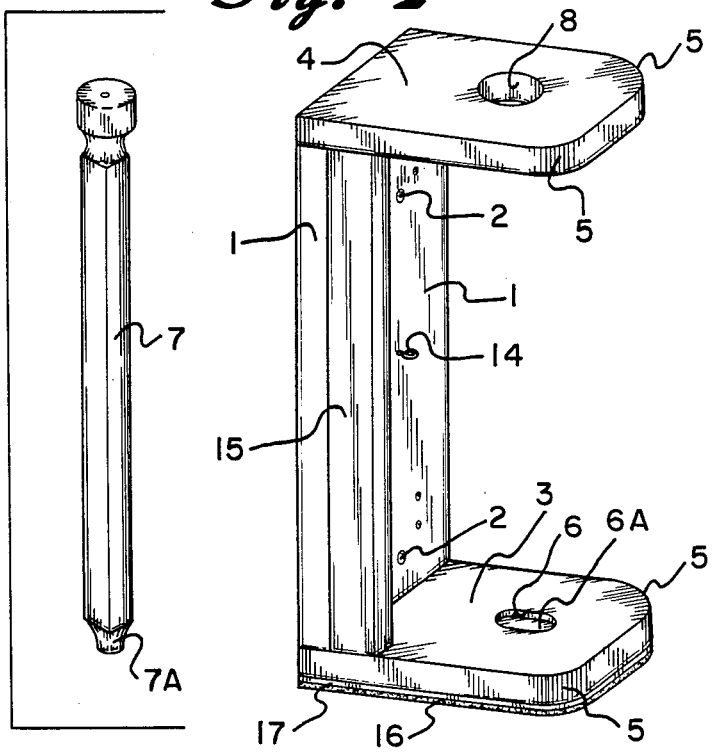
FIG. 2 is a partial view of the preferred embodiment.

FIG. 2, the vertical holder for perforated paper toweling or other material rolled on a tube, comprising of a rectangular back support 1, having a top end, a base end, and a frontward side; said rectangular back support having openings 2 to receive screws for mounting the holder on a wall vertically, horizontally, or underneath a counter or cabnet; said back support 1 having a base rod support 3, a top rod support 4 thereupon secured, each rod support having two rounded corners 5, the base rod support 3 having a shallow indentation 6 to receive the base end of paper roll rod 7. The indentation 6 slightly oblong and $\frac{1}{8}''$ closer to the front end of rod support 3 than opening 8 in top rod support 4, also a piece of metal 6 A therein to attract magnet 7A in end of rod 7, provides a non-shifting rod when the holder is mounted horizontally. Paper roll rod 7 is removable through opening 8 in top rod support 4; it is preferably square, its top and base ends round. The rod 7 having a diameter approximately the same as the opening in a paper roll, sufficiently eliminates the uneven distribution of the paper roll T, see FIG. 1, upon base rod support 3 by tension piece 9. FIG. 2; support 15 secured to a frontward edge of back support 1, also to base support 3, and top support 4, produces a strongly constructed holder and provides a grasping area for moving or carrying the vertical holder. The weight of the holder, aided by non-skid material 16 approximately the shape of base rod support 3, secured to plate metal 17 or other material, attached by screws through openings 18 to undersurface of rod support 3, provides a stable vertical holder when toweling is torn off, said attachment being removable, and not desirable for a holder mounted on a wall or ect., in some areas.

Figure 3:
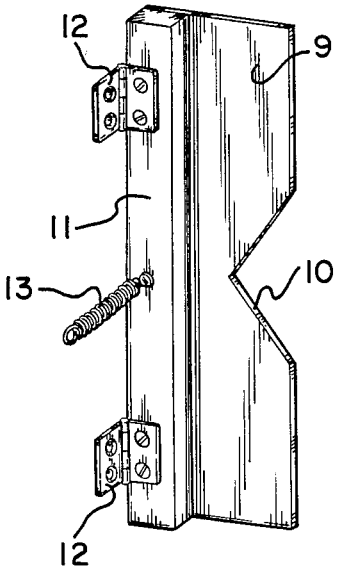
FIG. 3 is the tension piece for perforated toweling or other material.

FIG. 3, a rectangular tension piece, for perforated paper toweling or other material, said tension piece works freely between holder rod support ends 3 and 4, FIG. 2. Tension piece 9 having a small indentation 10 on one lengthwise side, for retrieving the paper edge, when occasionally removal of toweling leaves the edge back of tension piece. A support 11 secured to lengthwise side opposite indentation 10, said support having a hinge 12 near each end, said hinges attach tension piece to frontward side of back support 1, opposite side support 15, a spring 13 centrally located between hinges, attachable to eyelet 14 on back support 1, provides tension on roll toweling by tension piece 9, aiding separation of perforated sheet material, one length may be torn off, or several with one pull; no rolling of the toweling is experienced when the pull forward is stopped before the pull to tare off toweling. It is notable, the tension piece may be attached to right or left side of back support 1; and side support 15 opposite tension piece 9.

A variation of the present invention would be a shorter square roll support rod, approximately the length of roll material, secured to the base rod support by various means available, a top cover hinged to back support, and securable by hook and staple to side support of holder. All other parts of the holder are as presented.

The use of different material for construction of the holder may permit modification of some of its parts.

The rod support ends of the holder are disassimbled for packing and shipment.

What is claimed is:

1. A vertical holder for perforated paper toweling or the like rolled on a hollow tubular core, said holder comprising:

a substantially rectangularly shaped vertically extending rear support, said rear support having a bottom end, a top end, opposed left and right vertical side edges and a forward facing front surface;

top and bottom rod supports, each of said rod supports being substantially rectangular but having rounded front corners, said top and bottom supports being secured to said rear support adjacent the top end and bottom end thereof, respectively, and extending forwardly therefrom substantially perpendicular to said rear support;

an elongated support rod having a top end and a bottom end; said rod having a substantially square cross section throughout a substantial length thereof, each of said ends being of substantially circular cross section, the cross-sectional dimensions of said rod being slightly smaller than the inside diameter of the tubular core of a paper towel roll;

a substantially circular opening in said top support located substantially centrally thereof, said opening being large enough to allow said rod to pass therethrough;

a substantially oblong-shaped recess in said bottom support located substantially centrally thereof and facing upwardly, said recess being slightly closer to the front of said bottom support than said opening is to the front of said top support;

a magnet carried by said rod adjacent the bottom end thereof;

a magnetically attracted metallic member located within said recess and cooperating with said magnet to help maintain the bottom end of said rod in place in said recess;

a weighted base member secured to the underside of said bottom support, the bottom of said base member having a non-skid material thereon;

a substantially rectangularly shaped tension plate, said plate having a top edge, a bottom edge and front and rear edges, the rear edge of said plate being hinged to said rear support adjacent one of said right and left edges, spring means biasing said tension plate toward the center of said holder to that said front edge can press against a roll of towels supported therein, the height of said plate being less than the distance between said top and bottom rod supports so that said top and bottom edges can pass between said top and bottom supports, and a notch located in the front edge of said plate to aid the user in retrieving a towel edge which may lie behind the front edge of said plate.

2. The holder as claimed in claim 1 further including an elongated side support secured to said rear support adjacent the other of said right and left edges, said side support extending between and being secured to said top and bottom supports and is capable of being held by a user of said holder.

* * * * *